US009700743B2

(12) United States Patent
Castiglione et al.

(10) Patent No.: US 9,700,743 B2
(45) Date of Patent: Jul. 11, 2017

(54) RESPIRATORY ASSEMBLY INCLUDING LATCHING MECHANISM

(75) Inventors: David M. Castiglione, Hudson, WI (US); James R. Betz, Hudson, WI (US); Matthew D. Reier, Beaverton, OR (US)

(73) Assignee: 3M Innovative Properties Company, St. Paul, MN (US)

( * ) Notice: Subject to any disclaimer, the term of this patent is extended or adjusted under 35 U.S.C. 154(b) by 783 days.

(21) Appl. No.: 13/562,460

(22) Filed: Jul. 31, 2012

(65) Prior Publication Data

US 2014/0034049 A1 Feb. 6, 2014

(51) Int. Cl.

| | |
|---|---|
| ***B63C 9/08*** | (2006.01) |
| ***A62B 9/04*** | (2006.01) |
| ***A62B 7/10*** | (2006.01) |
| ***A62B 19/00*** | (2006.01) |

(52) U.S. Cl.

CPC ..... *A62B 9/04* (2013.01); *A62B 7/10* (2013.01); *A62B 19/00* (2013.01)

(58) Field of Classification Search

CPC .. A61M 16/0816; A61M 16/06; A61M 16/08; A61M 16/0875; A62B 9/04; A62B 7/10; A62B 19/00

USPC ..... 128/202.27, 206.17

See application file for complete search history.

(56) References Cited

U.S. PATENT DOCUMENTS

| | | | | |
|---|---|---|---|---|
| 3,124,373 | A | | 3/1964 | Thomsen |
| 3,177,018 | A | | 4/1965 | Goodwin |
| 3,718,350 | A | | 2/1973 | Klein |
| 3,747,140 | A | * | 7/1973 | Roberts ..... B63C 11/30 128/202.14 |
| 3,887,222 | A | | 6/1975 | Hammond |
| 3,990,727 | A | | 11/1976 | Gallagher |
| 4,111,197 | A | * | 9/1978 | Warncke et al. ..... 128/202.27 |
| 4,280,491 | A | | 7/1981 | Berg |
| 4,401,326 | A | | 8/1983 | Blair |
| 4,422,861 | A | | 12/1983 | Dusza |
| 4,437,460 | A | | 3/1984 | Glynn |
| 4,462,399 | A | | 7/1984 | Braun |
| 4,548,626 | A | | 10/1985 | Ackley |
| 4,565,392 | A | | 1/1986 | Vyse |

(Continued)

FOREIGN PATENT DOCUMENTS

| | | |
|---|---|---|
| JP | 07-022756 | 4/1995 |
| JP | 9-192246 | 7/1997 |

(Continued)

OTHER PUBLICATIONS

International Search Report for International Publication No. PCT/US2012/048919, dated Sep. 30, 2013.

*Primary Examiner* — Steven Douglas

(57) ABSTRACT

Respiratory assemblies are disclosed that include first and second respiratory components and a latching mechanism. The latching mechanism is capable of engaging at least one retaining feature of a respiratory component, thereby impeding disengagement of the first respiratory component from the second respiratory component. Upon application of force to the actuator, the at least one latch is capable of disengaging from the retaining feature, thereby allowing disengagement of the first respiratory component from the second respiratory component. Respiratory components including or adapted to work with such latching mechanisms are also disclosed.

13 Claims, 10 Drawing Sheets

(56) References Cited

U.S. PATENT DOCUMENTS

| | | | |
|---|---|---|---|
| 4,586,500 | A | 5/1986 | Glynn |
| 4,850,346 | A | 7/1989 | Michel |
| 4,867,487 | A | 9/1989 | Phillis |
| 4,886,056 | A | 12/1989 | Simpson |
| 4,934,361 | A | 6/1990 | Michel |
| 4,965,887 | A | 10/1990 | Paoluccio |
| 5,022,901 | A | 6/1991 | Meunier |
| 5,033,465 | A | 7/1991 | Braun |
| 5,036,844 | A | 8/1991 | Pouchot |
| 5,052,725 | A | 10/1991 | Meyer |
| 5,063,926 | A | 11/1991 | Forsgren |
| 5,074,601 | A | 12/1991 | Spors |
| 5,090,747 | A | 2/1992 | Kotake |
| 5,125,402 | A | 6/1992 | Greenough |
| 5,180,377 | A | 1/1993 | Holtermann |
| 5,222,488 | A | 6/1993 | Forsgren |
| 5,344,626 | A | 9/1994 | Abler |
| 5,356,183 | A | 10/1994 | Cole |
| 5,374,088 | A | 12/1994 | Moretti |
| 5,496,785 | A | 3/1996 | Abler |
| 5,579,761 | A | 12/1996 | Yuschak |
| 5,763,078 | A | 6/1998 | Braun |
| 5,882,044 | A | 3/1999 | Sloane |
| 5,924,420 | A | 7/1999 | Reischel |
| 5,951,728 | A | 9/1999 | Hopson |
| 6,014,971 | A | 1/2000 | Danisch |
| 6,055,983 | A | 5/2000 | Metzger |
| 6,119,691 | A | 9/2000 | Angadjivand |
| 6,139,308 | A | 10/2000 | Berrigan |
| 6,186,140 | B1 | 2/2001 | Hoague |
| 6,214,094 | B1 | 4/2001 | Rousseau |
| 6,216,693 | B1 | 4/2001 | Rekow |
| 6,250,299 | B1 | 6/2001 | Danisch |
| 6,354,564 | B1 | 3/2002 | Van Scyoc |
| 6,375,886 | B1 | 4/2002 | Angadjivand |
| 6,391,429 | B1 | 5/2002 | Senkus |
| 6,397,458 | B1 | 6/2002 | Jones |
| 6,406,657 | B1 | 6/2002 | Eitzman |
| 6,409,806 | B1 | 6/2002 | Jones |
| 6,454,986 | B1 | 9/2002 | Eitzman |
| 6,478,025 | B1 | 11/2002 | Yort |
| 6,491,034 | B1 * | 12/2002 | Gunaratnam et al. ... 128/204.18 |
| 6,575,165 | B1 | 6/2003 | Cook |
| 6,627,563 | B1 | 9/2003 | Huberty |
| 6,660,210 | B2 | 12/2003 | Redmond |
| 6,743,646 | B2 | 6/2004 | Jakatdar |
| 7,261,104 | B2 | 8/2007 | Kiefer |
| 7,320,722 | B2 | 1/2008 | Mittelstadt |
| 7,594,510 | B2 | 9/2009 | Betz |
| 8,286,633 | B2 | 10/2012 | Turker |
| 2002/0005199 | A1 | 1/2002 | Schmidtke |
| 2007/0071578 | A1 | 3/2007 | Shinozaki |
| 2010/0218761 | A1 | 9/2010 | Flannigan |
| 2010/0307506 | A1 | 12/2010 | Kielow |

FOREIGN PATENT DOCUMENTS

| | | |
|---|---|---|
| JP | 11-99214 | 4/1999 |
| JP | 2005-270492 | 10/2005 |
| RU | 47752 | 9/2005 |
| WO | WO 2007117688 | 10/2007 |

* cited by examiner

RESPIRATORY ASSEMBLY INCLUDING LATCHING MECHANISM

CROSS REFERENCE TO RELATED APPLICATIONS

This application claims the benefit of U.S. Provisional Patent Application No. 60/513,839, filed Aug. 1, 2011, the disclosure of which is incorporated by reference in its entirety herein.

The present invention pertains to respiratory protection devices and, more particularly, to respiratory assemblies including a latching mechanism for releasably engaging a first respiratory component with a second respiratory component.

BACKGROUND

Various respiratory protection devices are used to supply clean air to their users. In some cases, clean air is made available to the user by first drawing ambient air through a filter that is disposed in a filter cartridge. The filter cartridge can be attached to a respirator mask body that is worn on a person's face, over his or her nose and mouth. In such respiratory protection devices, ambient air is drawn through the filter due to negative pressure created by the wearer's inhalation. In other methods, clean air may be supplied to the user under pressure from a blower that forces ambient air through a filter. Such pressurized devices are known as powered air purifying respirators or PAPRs. Alternatively, clean air can be furnished to a user of a respiratory protection device from a pressurized tank. Such a device is known as a self-contained breathing apparatus or SCBA. In each of these devices, a clean air supply source (such as a filter cartridge or a hose from a PAPR or SCBA) is connected to a mask body that is worn over the nose and mouth of the user. The eyes and head may be covered as well if the user desires full face and head protection.

Several types of systems have been developed in the respirator art for attaching the clean air source to the respiratory mask. One common system uses a threaded component that is attached to a corresponding threaded fitting—see, for example, U.S. Pat. Nos. 5,222,488, 5,063,926, 5,036,844, 5,022,901, 4,548,626, 4,422,861 and 6,575,165. The threaded filter cartridges typically possess helical or advancing spiral threads that mate with a tapped collar or socket. Rotating the filter cartridge in an appropriate direction allows the cartridge to be attached to or removed from the respirator body. A resilient, deformable gasket has been used to ensure that an airtight fit is maintained at the interface. Detents have been used to releasably lock a threaded clean air supply in place. See, e.g., U.S. Pat. No. 6,575,165.

In lieu of a threaded attachment mechanism, bayonet type closures have been used to attach clean air sources to respirators. The bayonet type closure has locking tabs and notches to secure the components together. The locking tabs may project from a filter cartridge and may engage the notches in an aperture on the respirator body. When the filter cartridge is rotated in the appropriate direction, the cartridge engages the mask body—see U.S. Pat. Nos. 6,216,693 and 5,924,420. The benefit of using a bayonet-type fitting is that the cartridge can engage the mask body with a quick turn, usually less than about one-half turn.

An audible indication device has been used in bayonet closure systems to indicate that the filter cartridge is properly coupled to the respirator face piece—see U.S. Pat. Nos. 4,934,361, and 4,850,346. A lug on the face piece has been provided with a détente ramp or cam that has an inclined surface, which is positioned to gradually deflect or deform a rib on the cartridge. As the cartridge and face piece are rotated relative to each other into a locking position, the cam engages the rib and causes the rib and lug to deflect until the rib abruptly drops off the end of the cam. The abrupt action produces the audible click.

Respirators that have snap-fit filter cartridges also have been designed as shown in U.S. Pat. No. 5,579,761 to Yushack et al. In this approach, the filter cartridge is instantaneously snapped into engagement with the mask body simply by pressing the cartridge against a corresponding receiving structure on the mask body. No rotational movement of the filter cartridge is needed.

Also known are respiratory protection devices, in which threaded portions of the clean air supply source and the clean air receiving structure engage each other at a high thread pitch and include an integral détente. A stop prevents overrotation of the clean air supply source relative to the mask body during the securement operation. See U.S. Pat. No. 7,320,722 to Mittelstadt et al.

SUMMARY

In one implementation, the present disclosure is directed to a respiratory assembly including first and second respiratory components. The first respiratory component has a receiving surface including a first axial passageway therein. The second respiratory component has at least one retaining feature and a second axial passageway configured and dimensioned to be disposed in fluidic communication with the first axial passageway such that the second respiratory component forms a sealed connection with the receiving surface of the first respiratory component. The respiratory assembly further includes a latching mechanism attached to the first respiratory component, the latching mechanism comprising a resilient member, at least one latch projecting inwardly toward the first axial passageway, and a latch actuator. The at least one latch is capable of engaging the at least one retaining feature, thereby impeding disengagement of the first respiratory component from the second respiratory component. Upon application of force to the actuator, the at least one latch is capable of disengaging from the retaining feature, thereby allowing disengagement of the first respiratory component from the second respiratory component.

In another implementation, the present disclosure is directed to a respiratory assembly including a first respiratory component having a port for releasably connecting the first respiratory component to a second respiratory component. The port has a receiving surface having a first axial passageway therein and a latching mechanism attached thereto. The latching mechanism comprises a resilient member, at least one latch projecting inwardly toward the first axial passageway, and a latch actuator. Upon application of force to the actuator, the at least one latch is capable of moving away from the first axial passageway.

In yet another implementation, the present disclosure is directed to a respiratory assembly including a first respiratory component having a port for releasably connecting the first respiratory component to a second respiratory component. In this implementation, the port includes a projection having an axial passageway therein, a retaining shoulder disposed on an external surface of the projection, and a sealing member disposed on an outer end of the annular projection.

BRIEF DESCRIPTION OF THE DRAWINGS

The invention may be more completely understood in consideration of the following detailed description of various embodiments of the invention in connection with the accompanying drawings, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

Figure 1:
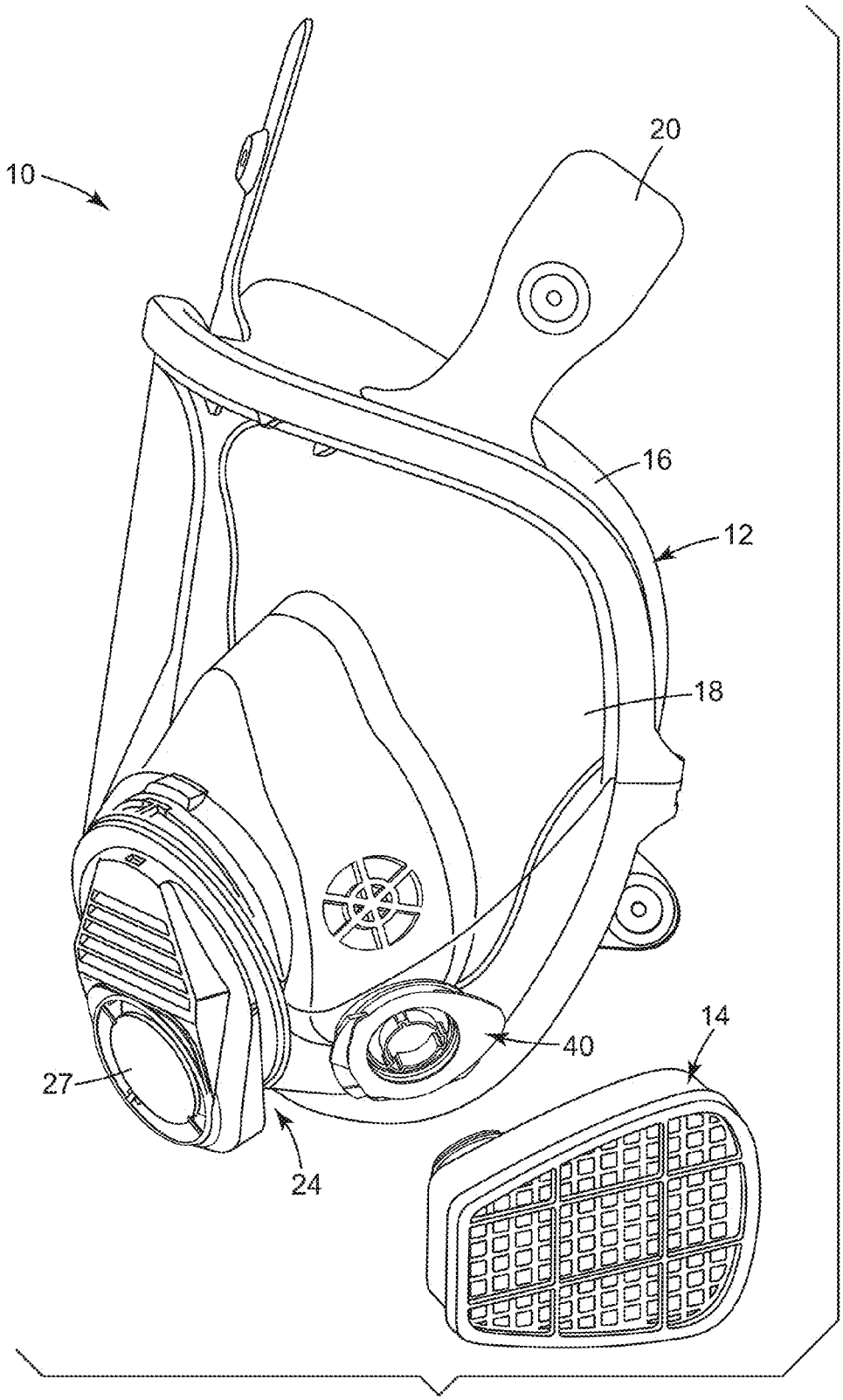
FIG. 1 illustrates an exemplary respiratory assembly according to the present disclosure.

FIG. 1 illustrates one respiratory assembly 10 according to the present disclosure. In this exemplary embodiment, the respiratory assembly 10 includes a negative pressure personal respiratory protection device. The respiratory assembly 10 includes a first respiratory component 12 (here, a mask body) and a second respiratory component 14 (here, a clean air supply source such as a filter element or a filter cartridge). The respiratory protection device illustrated in FIG. 1 is referred to as a "negative pressure" respiratory protection device or mask, since it primarily relies on the wearer's lungs to draw air into the mask, in contrast to a "positive pressure" source such as a powered fan or compressed air. As indicated above, positive pressure respiratory protection devices or masks use air from a blower or pressure tank, which devices are commonly carried by the wearer, to deliver the supply of clean air or oxygen. The positive pressure systems regularly use a hose, or another appropriate conduit, as the attachment component for the clean air supply source. Examples of PAPRs are shown in U.S. Pat. Nos. 6,250,299, 6,186,140, 6,014,971, 5,125,402, 4,965,887, 4,462,399, and 4,280,491. PAPRs force air through a filter that may be placed in a unit that is worn about the waist of a user. Examples of SCBA systems are shown in U.S. Pat. Nos. 6,478,025, 4,886,056, 4,586,500, and 4,437,460.

In FIG. 1, the first respiratory component 12 is illustrated as a body portion of a full face respirator mask that fits over at least nose, mouth and eyes of the wearer—see, for example, U.S. Pat. No. 5,924,420 to Reischel et al. However, the use of a "half face" mask, which fits over the nose and mouth of the wearer—is also within the scope of the present disclosure, see, for example, U.S. Pat. No. 7,320,722 to Mittelstadt et al. The exemplary first respiratory component 12 may include a compliant face contacting member 16, a rigid structural member 18, and one or more harness or strap receiving structures 20 located thereon for receiving a harness or one or more straps, which enable the respiratory assembly 10 to be supported on a person's head when in use. The rigid structural member 18 may include at least one exhalation port 24 that allows exhaled air to be exhausted from the interior gas space. The interior gas space is defined as the space between the mask body and a wearer's face. An exhalation valve (here, covered by an exhalation valve cover 27) can be provided on the mask body 12 to preclude air from entering the interior gas space during an inhalation, while also allowing exhaled air to be rapidly exhausted from that space during an exhalation. Examples of exhalation valves that could be used in connection with respiratory assemblies of the present disclosure include those having a flexible flap that dynamically opens in response to exhaled air.

Figure 1A:
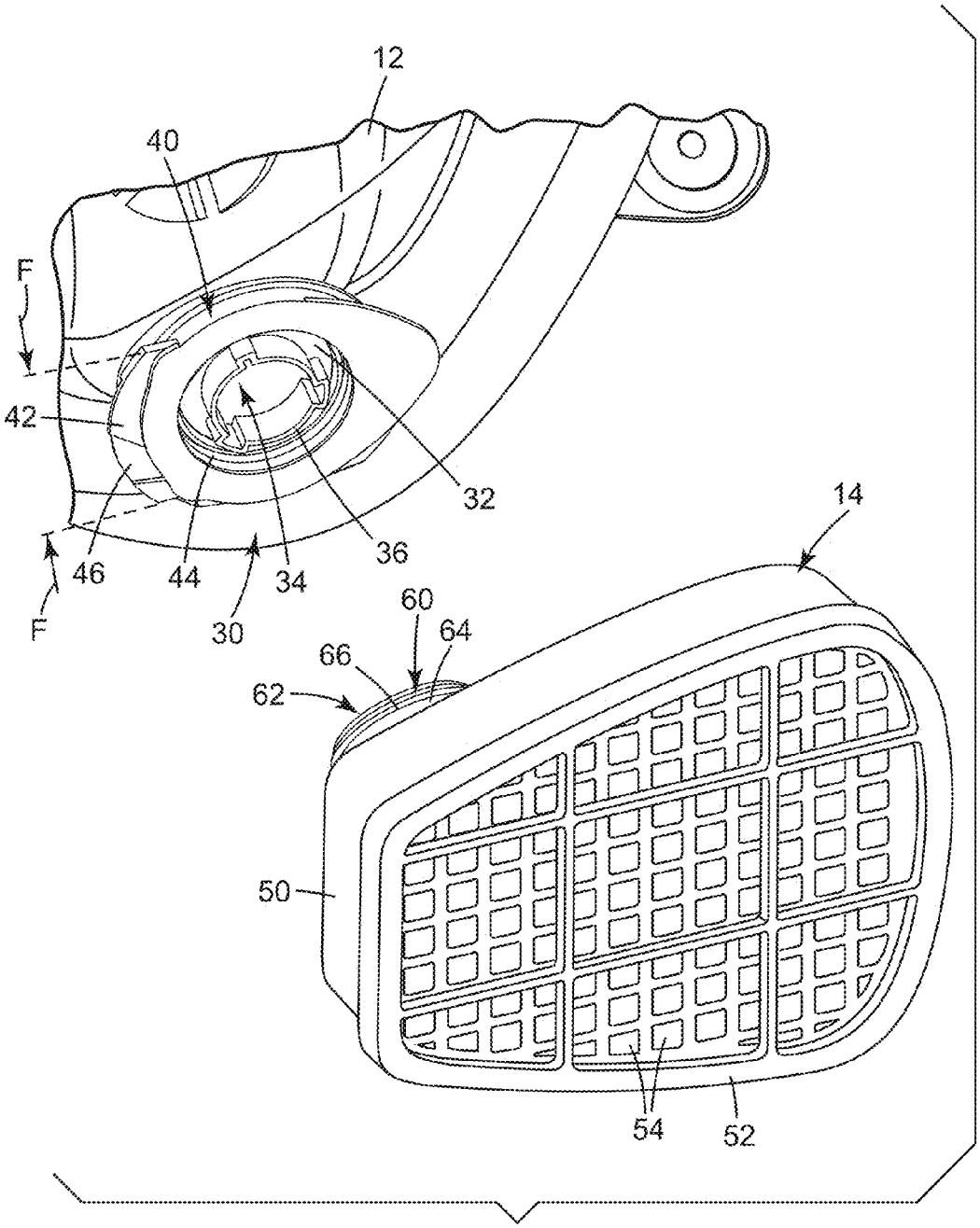
FIG. 1A shows an enlarged partial view of the respiratory assembly of FIG. 1.

Referring further to FIGS. 1 and 1A, the exemplary first respiratory component 12 includes a port 30 for releasably connecting the first respiratory component 12 to the second respiratory component 14. The port 30 may include a receiving surface 32 having a first axial passageway 34 therein. A first projection 36 may be disposed on the receiving surface 32 and it may be configured and dimensioned to surround the first axial passageway 34. Preferably, the first projection is generally annularly shaped. The respiratory assembly 10 includes a latching mechanism 40. The latching mechanism 40 of this exemplary embodiment is attached to the first respiratory component 12. However, in other exemplary embodiments, the latching mechanism 40 may be attached to the second respiratory component 14. The latching mechanism 40 includes a resilient member 42, at least one latch 44 projecting inwardly toward the first axial passageway 34 and a latch actuator 46. The latching mechanism is configured such that, upon application of force to the actuator, the at least one latch 44 is capable of moving away from the first axial passageway 34. In this exemplary embodiment, the actuator 46 comprises free ends of the latching mechanism 40 and the requisite force can be applied by squeezing together free ends of the latching mechanism as shown by arrows F in FIG. 1A. Other embodiments and further features of latch mechanisms of the present disclosure are discussed below in reference to FIGS. 2A-4.

With further reference to FIGS. 1 and 1A, the second respiratory component 14 can be a filter cartridge that has a housing 50 in which a filter element can be contained (filter element not shown). In other exemplary embodiments, a filter element can be provided without a housing. A housing cover or grid 52 may be provided on the front face of the second respiratory component 14 to enclose and protect the filter element. The cartridge cover 52 may have multiple openings 54 located therein to allow air from the exterior gas space to be easily drawn through the cover 52 so that it can be filtered by the filter element during an inhalation. The filter element could be or include a gaseous and/or particulate filter, examples of which are shown or discussed in the following patent documents: U.S. Pat. No. 6,743,464 to Insley et al., U.S. Pat. No. 6,627,563B1 to Huberty, U.S. Pat. No. 6,454,986 to Eitzman et al., U.S. Pat. Nos. 6,660,210, 6,409,806, and 6,397,458 to Jones et al., U.S. Pat. No. 6,406,657 to Eitzman et al, U.S. Pat. No. 6,391,429 to Senkus et al., U.S. Pat. No. 6,375,886 to Angadjivand et al., U.S. Pat. No. 6,214,094 to Rousseau et al., U.S. Pat. No. 6,139,308 to Berrigan et al., and U.S. Pat. No. 6,119,691 to Angadjivand et al., U.S. Pat. Nos. 5,763,078 and 5,033,465 to Bran et al., and U.S. Pat. Nos. 5,496,785 and 5,344,626 to Abler. Gaseous filters may include activated carbon granules in, for example, packed bed or bonded form. Particulate filters may include electrically-charged microfibers that are in the form of a non-woven fibrous web.

The second respiratory component 14 further includes a port 60 for releasably connecting the second respiratory component 14 to the first respiratory component 12. The port 60 includes a second axial passageway 62 that is in fluid communication with the ambient air via the filter element, such that a user's inhalation causes ambient air to be drawn through the openings 54 in the cartridge cover 52, through the filter element and into the second axial passageway 62. The second axial passageway 62 is configured and dimensioned to be disposed in fluidic communication with the first axial passageway 34 of the first respiratory component 12 when the second respiratory component 14 is attached to the first respiratory component 12. Preferably, the second respiratory component 14 then forms a sealed connection with the receiving surface 32 of the first respiratory component 12.

The second respiratory component 14 also includes at least one retaining feature 66, which may, in some embodiments, be disposed on a second projection 64. The second projection 64 can be configured and dimensioned to surround the second axial passageway 55. The second projection 64 is preferably annularly-shaped. At least one retaining feature 66 is configured such that at least one latch 44 is capable of engaging the least one retaining feature 66, thereby impeding disengagement of the first respiratory component 12 from the second respiratory component 14. Further, upon application of force to the latch actuator 46, the at least one latch 44 is capable of disengaging from the at least one retaining feature 66, thereby allowing disengagement of the first respiratory component 12 from the second respiratory component 14.

Those of ordinary skill in the art will readily appreciate that various modifications can be made to exemplary embodiments described above that are within the scope of the present disclosure. For example, various features illustrated as being a part of the first respiratory component 12 (such as one or more of the port 30, the receiving surface 32, the latching mechanism 40, etc.) may instead be a part of the second respiratory component 14 and vice versa.

Figure 2A:
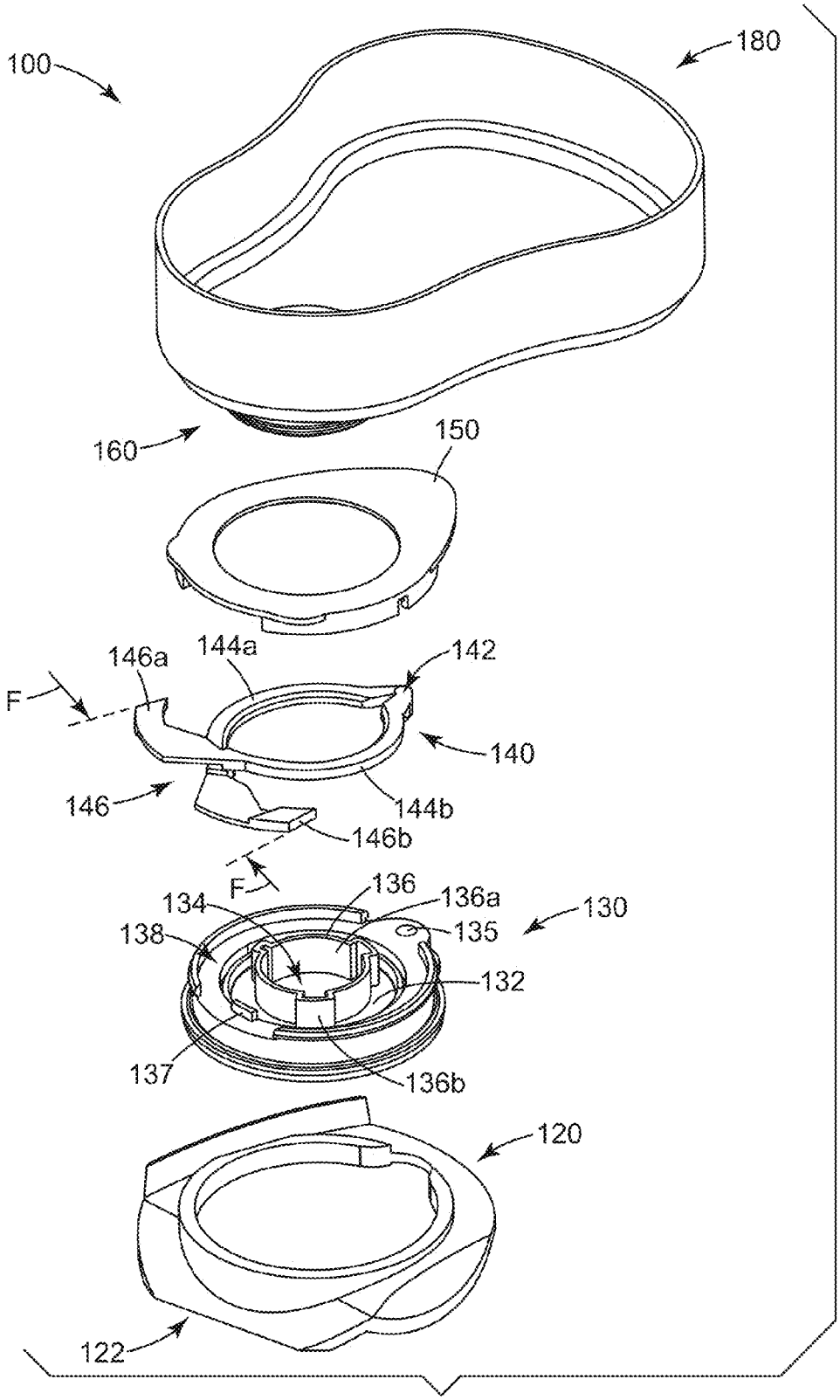
FIG. 2A shows a partial exploded view of another exemplary respiratory assembly.
Figure 2B:
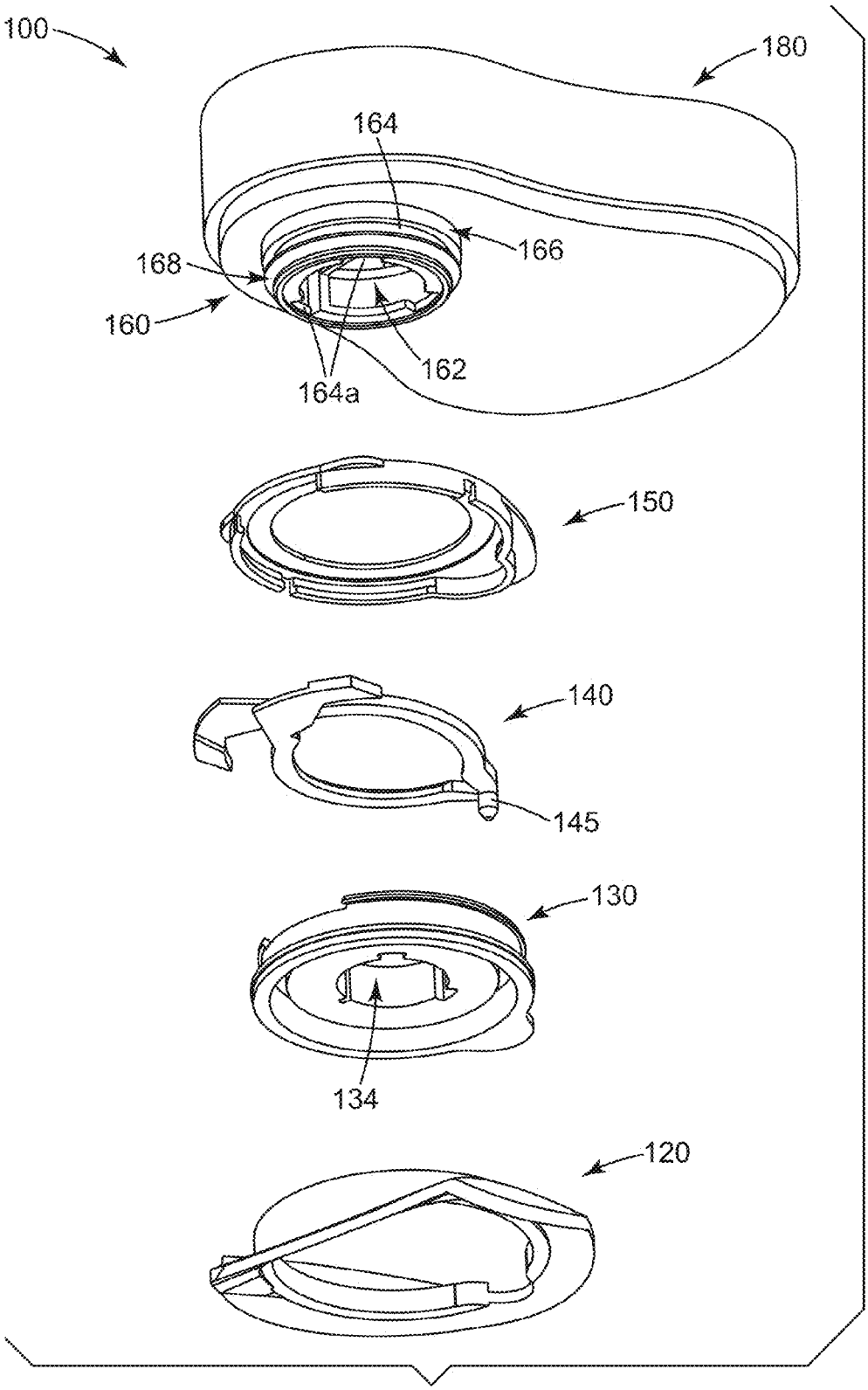
FIG. 2B shows a complementary partial exploded view of the respiratory assembly shown in FIG. 2A.
Figure 2C:
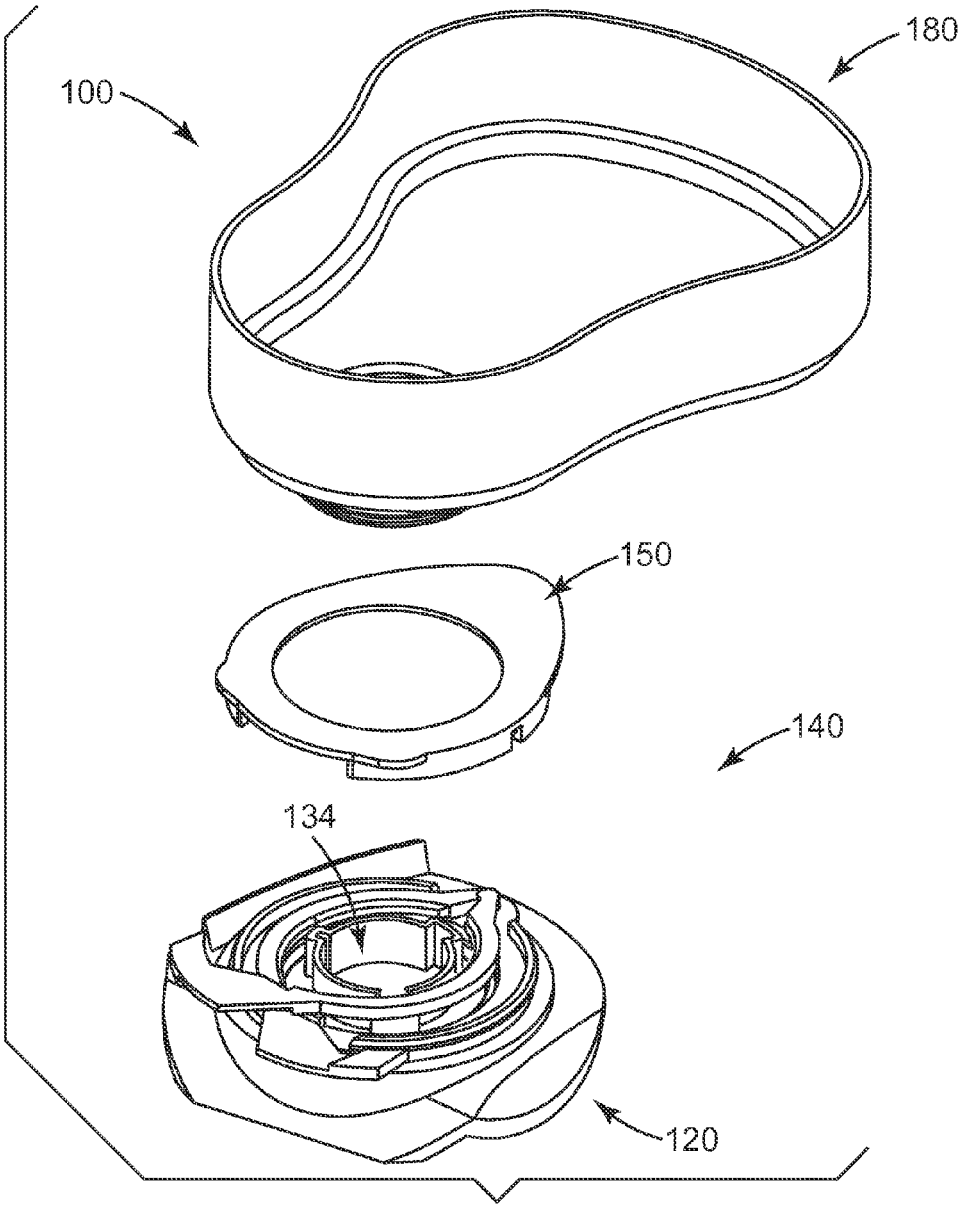
FIG. 2C shows another view of the respiratory assembly shown in FIGS. 2A and 2B.
Figure 2D:
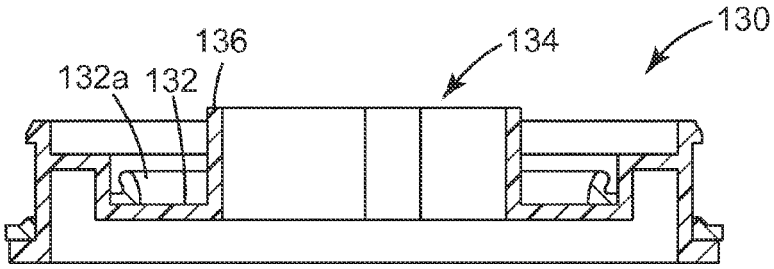
FIG. 2D shows a cross-sectional view of a port of an exemplary respiratory assembly according to the present invention.

FIG. 2A shows a partial exploded view of another exemplary respiratory assembly 100 according to the present disclosure. FIG. 2B shows a complementary partial exploded view of the respiratory assembly 100 for better illustration of the features that are hidden in FIG. 2A. FIG. 2C shows yet another view of the respiratory assembly 100, with some of the constituent components assembled together. The exemplary respiratory assembly 100 includes a first respiratory component 120 (shown schematically as a section of a respirator mask) and a second respiratory component 180 (shown schematically as a part of a filter cartridge). The exemplary first respiratory component 120 includes a port 130 for releasably connecting the first respiratory component 120 to the second respiratory component 180. The port 130 includes a receiving surface 132 having a first axial passageway 134 therein. A first projection 136 is disposed on the receiving surface 132 and configured and dimensioned to surround the first axial passageway 134. Preferably, the first projection includes generally cylindrically shaped wall portions 136*a*. The first projection may further include one or more locating and/or anti-rotation features, such as one or more lugs 136*b*. Additionally or alternatively, the receiving surface 132 may define a recess disposed around the first axial passageway.

The exemplary second respiratory component 180 includes a port 160 for releasably connecting the second respiratory component 180 to the first respiratory component 120. The port 160 includes a second axial passageway 162 configured and dimensioned to be disposed in fluidic communication with the first axial passageway 134 of the first respiratory component 120 when the second respiratory component 180 is attached to the first respiratory component 120. A second projection 164 is configured and dimensioned to surround the second axial passageway 162. In some exemplary embodiments, the first projection 136 is configured to be received within the second projection 164. The second projection 164 may be generally annularly shaped. One or more locating and/or anti-rotation features 164*a*, configured to mate with one or more locating/anti-rotation features 136*b* of the first projection 136, may be found on the second projection 164. In one embodiment, the one or more locating and/or anti-rotation features 164*a* may be one or more recesses configured to receive one or more lugs 136*b*. Other configurations of the locating/anti-rotation elements are within the scope of the present disclosure. Generally, the first and second respiratory components may each comprise at least one mating anti-rotation element disposed adjacent the first and second annularly shaped projections.

The second respiratory component 180 also includes at least one retaining feature 166, such as one or more shoulders or ledges, which may be disposed on the second projection 164, shown in FIGS. 2A-C as a ring-shaped shoulder or ledge disposed around the second passageway 162. In other exemplary embodiments, one or more retaining features could comprise a plurality of tabs or projections, disposed, for example, about the circumference of the axial passageway, for example, on the second projection 164. In some exemplary embodiments, the port 130 of the first respiratory component 120 comprises a sealing element 132*a*, shown in FIG. 2D. In the illustrated embodiment, the sealing element 132*a* includes a lip seal disposed on the receiving surface 132. Preferably, the lip seal surrounds the first axial passageway 134. The sealing element 132*a* may be configured to cooperate with a sealing element of the port 160 of the second respiratory component 180, such as a slanted sealing surface 168.

The sealing element can be made from or include a flexible rubber or rubber-like materials. Exemplary suitable materials include thermoplastic elastomers such as Kraton® or Monprene® block copolymers, thermoplastic vulcanates, such as the Santoprene® material, or various thermoset rubber materials, such as natural latex rubber, polyisoprene, nitrile, EPDM, butyl or silicone rubber. The sealing element 132*a* can be removably attached or assembled to a component of a respiratory assembly, or, the sealing element 132*a* can be overmolded and permanently adhered directly to such a component. An alternate arrangement of a sealing element could include a compression gasket, potentially on the receiving surface 132, or a flexible closed cell foam element. Another alternative sealing element arrangement could employ an o-ring type seal that could be in compression against surface 132 for example, or in sliding radial compression on the radial mating surfaces of the first and second respiratory components. Any of the exemplary sealing elements according to the present disclosure could be disposed at any suitable location of the first respiratory component, the second respiratory component or both.

The respiratory assembly 100 further includes a latching mechanism 140. The latching mechanism 140 of this exemplary embodiment may be removably or fixedly attached to the first respiratory component 120. For example, the port 130 may be inserted into the opening 122 of the first respiratory component 120 such that at least a portion of the port is on one side of the opening and at least a portion of it is on another side. For example, the port 130 may have a flat flange around the perimeter to stop it from going through the opening. The latching mechanism 140 may be assembled into the port 130, and the cover 150 attached to the port 130 over the latching mechanism 140, for example via a snap-fit attachment, to retain the port 130 and the latching mechanism 140 to the first respiratory component 120.

The latching mechanism 140 includes a resilient member 142 and first and second latches 144*a* and 144*b*, projecting inwardly toward the first axial passageway 134 when the latching mechanism is assembled with the first respiratory component, such that they engage the at least one retaining feature 166, thereby impeding disengagement of the first respiratory component 120 from the second respiratory component 140. The first latch 144*a* is disposed on one side of the axial passageway 134, while the second latch 144*b* is disposed on another side of the axial passageway 134, preferably, opposite the second latch 144*b*.

One or both latches 144*a* and 144*b* can have an arcuate shape allowing them to curve around the first axial passageway 134, as well as an annular projection 136, where present. In one embodiment, the first and second latches 144*a* and 144*b* each comprise an arm having a free end 146*a* and 146*b*. The arms may be connected to each other at one location and cross at another location. For example, in the illustrated embodiment, the latches 144*a* and 144*b* are connected to each other via a resilient member 142. The resilient member 142 may be a separate part connecting the arms or a region formed integrally with the arms, or it may be any other portion of the latching mechanism 140. In an exemplary embodiment, the entire latching mechanism may be considered a resilient member 142. The resilient member 142 is flexible enough to allow the latches 144*a* and 144*b* to deflect and move sufficiently far from the first axial passageway 134 of the first respiratory component 120, when force is applied to its actuator 146, so as to disengage the latching mechanism 140 from the retaining feature 166 of the second respiratory component 180. On the other hand, the resilient member 142 must be resilient enough to return to its original shape when the force is removed.

In one embodiment, the latches 144*a* and 144*b* are biased with respect to each other. Particularly, in the unloaded state of the latch 140, illustrated in FIGS. 2A and 2B, the arms 144*a* and 144*b* of the latch 140 are crossed at a location closer to their connected end than when the latch is inserted into the port 130, as shown in FIG. 2C. When the latch 140 is inserted into the port 130, the tab 137 disposed between the arms 144*a* and 144*b* and maintains the arms in a flexed state even before any force is applied to the actuator 146. In some exemplary embodiments, the latching mechanism 140 may be anchored in a depression 135 formed in the port 130 of the first respiratory component 120 using a pin 145. In such exemplary embodiments, the first and second arms may be pivotable about the pin 145. The latching mechanism 140 may be assembled with the port 130 by inserting the pin 145 into the depression 135. Biasing the first and second latches 144*a* and 144*b* with respect to each other helps further ensure a secure connection between the first and second respiratory components. Thus, the latches are forced remain in the latched position when at rest, thus engaging the retaining feature 166 at all times, unless the mechanism is intentionally released by the user.

The latch actuator 146 of the illustrated embodiment includes two free ends 146*a* and 146*b* of the arms that serve as the latches 144*a* and 144*b*. In such exemplary embodiments, the first and second arms may cross proximate their free ends to provide additional leverage for actuation. The latching mechanism 140 can be operated as follows. When force is applied to at least one (and, preferably, both) of the free ends 146*a* and 146*b* in the direction towards the other free end, as illustrated by the arrows F in FIG. 2A, the latches 144*a* and 144*b*, move away from the first axial passageway 134. Once the latches 144*a* and 144*b* clear and disengage from the retaining feature 166, the second respiratory component 180 may be disengaged from the first respiratory component 120. Conversely, when no force is applied to the actuator 146, or the applied force is insufficient for the latches 144*a*, 144*b* to clear the one or more retaining features 166, the one or more latches remain retained by the one or more retaining features, thereby impeding disengagement of the first respiratory component from the second respiratory component.

One or more components of a latching mechanism according to the present disclosure may be made from or include polymeric materials or resins, metals, or a combination thereof. In some embodiments, the latching mechanism may include or be made from thermoplastic resins, such as any one or more of polycarbonate, nylon, polybutylene terephthalate (PBT), polypropylene and acrylonitrile-butadiene-styrene (ABS). In some embodiments, it may be desirable to make one or more components, for example one or more latches and/or resilient element out of metal, such as spring steel to reduce the size of a component.

Figure 3A:
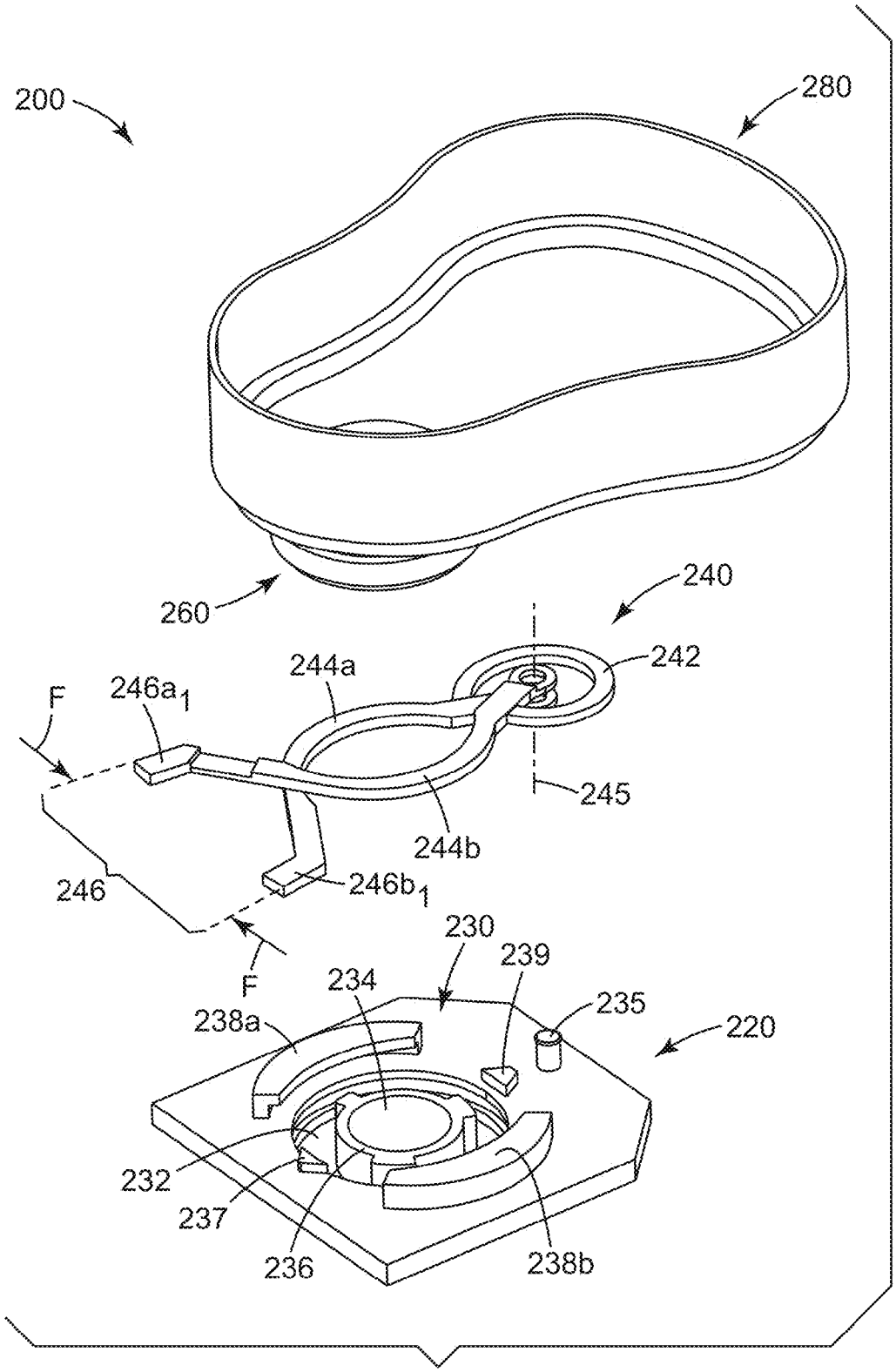
FIG. 3A shows a partial exploded view of another exemplary respiratory assembly.
Figure 3B:
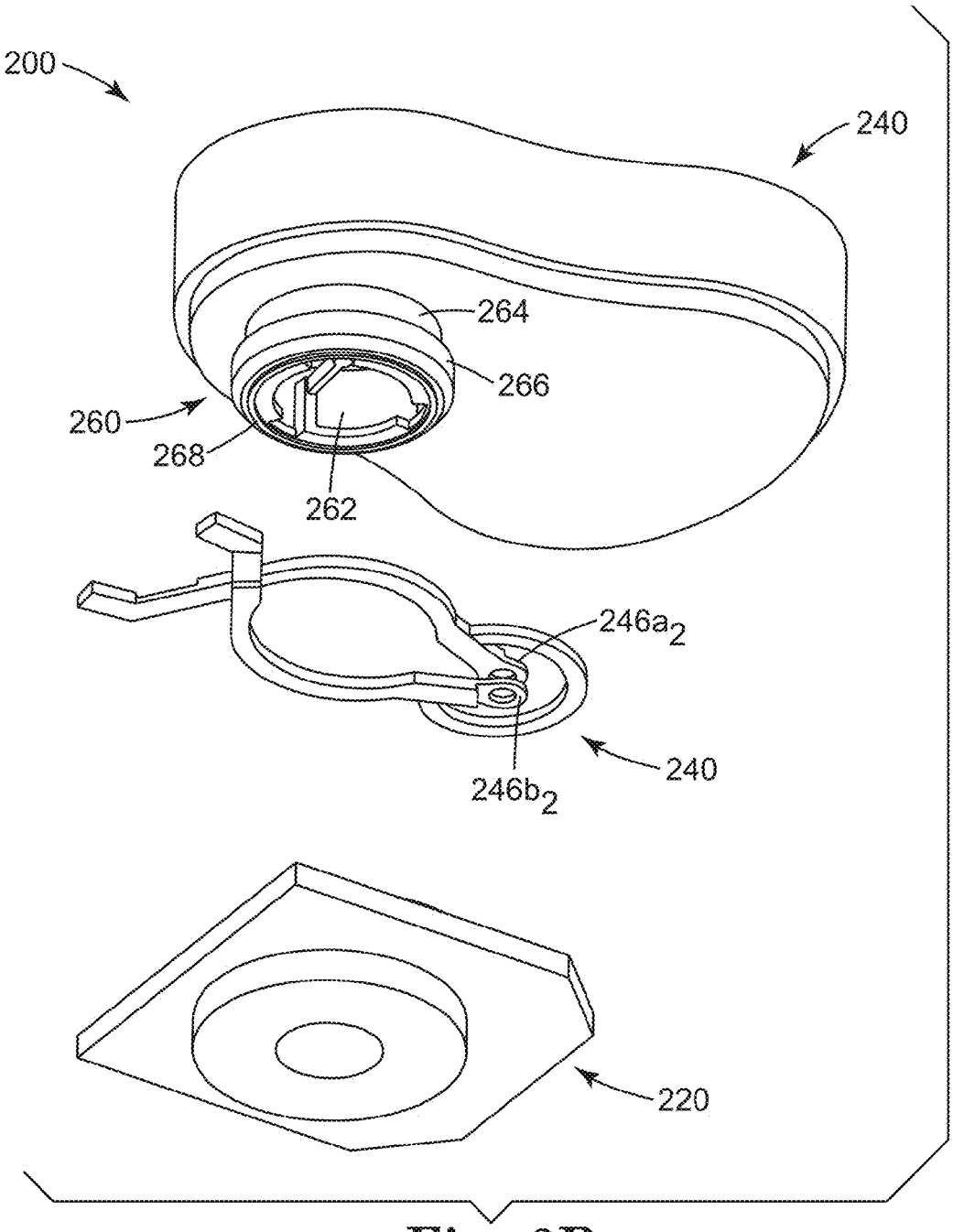
FIG. 3B shows a complementary partial exploded view of the respiratory assembly shown in FIG. 3A.

FIG. 3A shows a partial exploded view of another exemplary respiratory assembly 200 according to the present disclosure. FIG. 3B shows a complementary partial exploded view of the respiratory assembly 200 for better illustration of the features that are hidden in FIG. 3A. The exemplary respiratory assembly 200 includes a first respiratory component 220 and a second respiratory component 280. The exemplary first respiratory component 220 includes a port 230 for releasably connecting the first respiratory component 220 to the second respiratory component 280. The port 230 includes a receiving surface 232 having a first axial passageway 234 therein. A first projection 236 is disposed on the receiving surface 232 and configured and dimensioned to surround the first axial passageway 234. Additionally or alternatively, the receiving surface 232 may define a recess disposed around the first axial passageway.

The exemplary second respiratory component 280 includes a port 260 for releasably connecting the second respiratory component 280 to the first respiratory component 220. The port 260 includes a second axial passageway 262 configured and dimensioned to be disposed in fluidic communication with the first axial passageway 234 of the first respiratory component 220 when the second respiratory component 280 is attached to the first respiratory component 220. A second projection 264 is configured and dimensioned to surround the second axial passageway 262. In some exemplary embodiments, the first projection 236 is configured to be received within the second projection 264, which may be generally annularly shaped.

The first and second respiratory components may each comprise at least one mating anti-rotation element disposed adjacent the first and second annularly shaped projections. The second respiratory component 280 also includes at least one retaining feature 266, which may be disposed on the second projection 264, shown as a ring-shaped shoulder disposed around the second passageway 262. The port 260 of the second respiratory component 280 may also comprise a sealing element 268, which may be a slanted surface disposed on an outermost surface of the second projection 264. Additionally or alternatively, the port 230 of the first respiratory component may comprise a sealing element, such as a lip seal described in connection with FIG. 2D. The lip seal may be disposed on the receiving surface 232 of the first respiratory component 220.

The respiratory assembly 200 further includes a latching mechanism 240. The latching mechanism 240 of this exemplary embodiment is attached to the first respiratory component 220. The latching mechanism 240 includes a resilient member 242, which in this exemplary embodiment is arcuately shaped. First and second latches 244*a* and 244*b* project inwardly toward the first axial passageway 234 when the latching mechanism is assembled with the first respiratory component, such that they engage the at least one retaining feature 266, thereby impeding disengagement of the first respiratory component 220 from the second respiratory component 240. The first latch 244*a* is disposed on one side of the axial passageway 234, while the second latch 244*b* is disposed on another side of the axial passageway 234, preferably, opposite the first latch 244*a*.

The latches 244*a* and 244*b* include curved regions allowing each latch to curve around the first axial passageway 234, as well as an annular projection 236, where present. The first and second latches 244*a* and 244*b* each comprise an arm having a first free end $246a_1$ or $246b_1$ and a second free end $246a_2$ or $246b_2$. The first and second arms may be crossed proximate the first free ends, similarly to an exemplary embodiment described in connection with FIGS. 2A-C, and the first free ends may serve as an actuator 246.

The exemplary arms 244*a* and 244*b* are connected to each other by the arcuate resilient member 242, preferably in the vicinity of the second free ends $246a_2$ and $246b_2$. The resilient member 242 may be a separate component attached to the arms or it may be formed integrally with the arms. The resilient member 242 is flexible enough to allow the latches 244*a* and 244*b* to deflect and move sufficiently far from the first axial passageway 234 of the first respiratory component 220, when force is applied to its actuator 246, so as to disengage the latching mechanism 240 from the retaining feature 166 of the second respiratory component 280. On the other hand, the resilient member 242 must be resilient enough to return to its original shape when the force is removed. The second free ends of the $246a_2$ and $246b_2$ may be connected, for example, by providing an opening in each of the second free ends that is configured to receive and retain a post 235 of the first respiratory component 220. Thus, the first and second arms may be pivotable about the axis 245.

The latching mechanism 240 can be operated in a manner similar to the operation of the latching mechanism 140. In particular, when force is applied to at least one (and, preferably, both) of the first free ends $246a_1$ and $246b_1$ in the direction towards the other free end, as illustrated by the arrows F in FIG. 3A, the latches 244*a* and 244*b*, move away from the first axial passageway 234. Once the latches 244*a* and 244*b* clear and disengage from the retaining feature 266, the second respiratory component 280 may be disengaged from the first respiratory component 220. Conversely, when no force is applied to the actuator 246, or the applied force is insufficient for the latches 244*a*, 244*b* to clear the one or more retaining features 266, the one or more latches remain retained by the one or more retaining features, thereby impeding disengagement of the first respiratory component from the second respiratory component.

The port 230 may further include channels 238*a* and 238*b* configured to receive and retain the latches 244*a* and 244*b*, respectively. To attach the latching mechanism 240 to the port 230, one would insert the pin 235 into the openings of the second free ends of the 246*a*2 and 246*b*2 of the latches 244*a* and 244*b* of the latching mechanism 240 and insert the latches 244*a* and 244*b* into the channels 238*a* and 238*b*. Tabs 237 and 239 may be disposed on the port 230 for locating and positioning the latches 244*a* and 244*b*.

Figure 4:
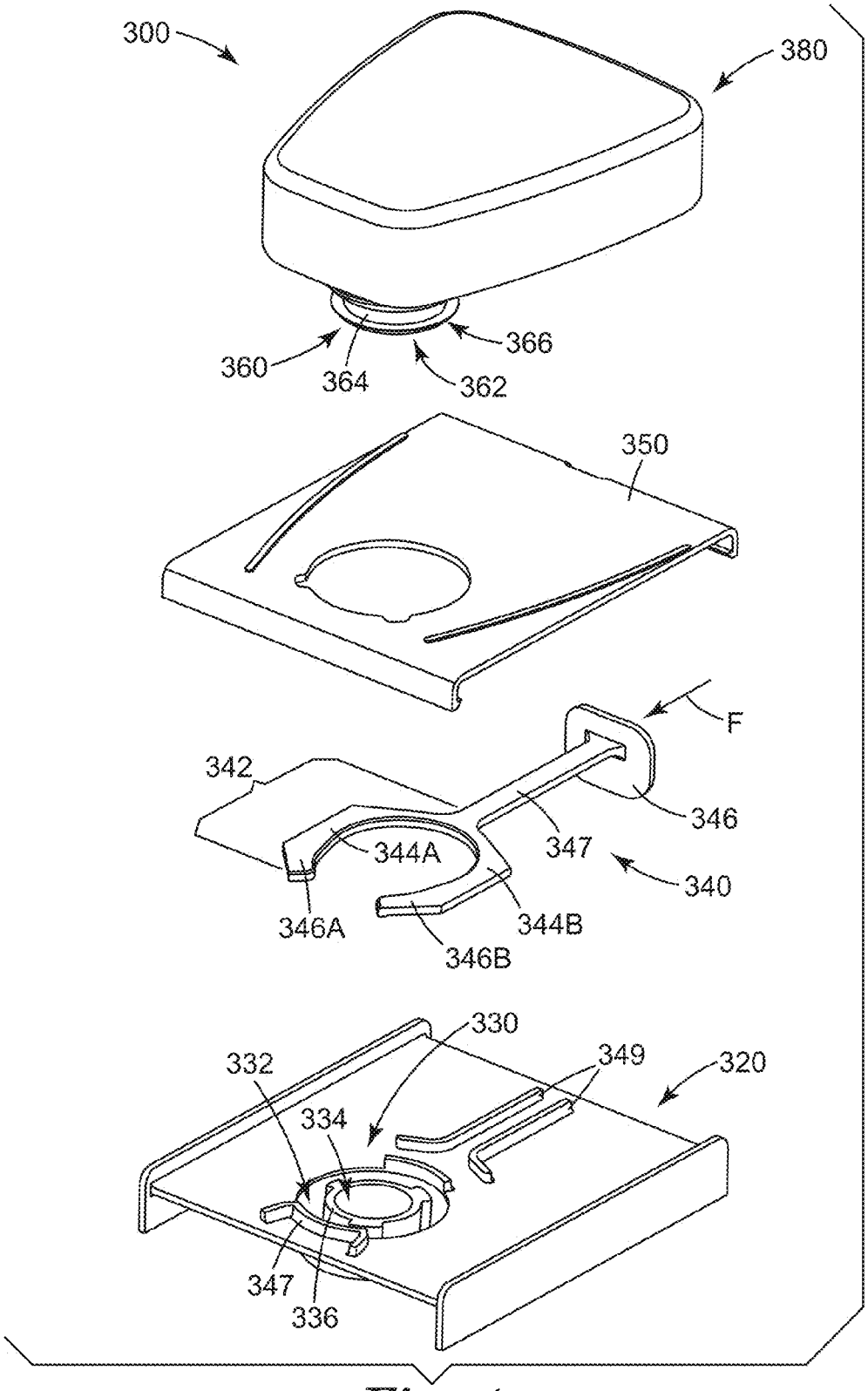
FIG. 4 shows a partial exploded view of another exemplary respiratory assembly.

FIG. 4 shows a partial exploded view of yet another exemplary respiratory assembly 300 according to the present disclosure. The exemplary respiratory assembly 300 includes a first respiratory component 320 and a second respiratory component 380. The exemplary first respiratory component 320 includes a port 330 for releasably connecting the first respiratory component 320 to the second respiratory component 380. The port 330 includes a receiving surface 332 having a first axial passageway 334 therein and a first projection 336 disposed on the receiving surface 332 and configured and dimensioned to surround the first axial passageway 334. The second respiratory component 380 includes a port 360 for releasably connecting the second respiratory component 380 to the first respiratory component 320. The port 360 includes a second axial passageway 362 configured and dimensioned to be disposed in fluidic communication with the first axial passageway 334, when the second respiratory component 380 is attached to the first respiratory component 320, and a second projection 364 configured and dimensioned to surround the second axial passageway 362. In some exemplary embodiments, the first projection 336 is configured to be received within the second projection 364. The second respiratory component 380 also includes at least one retaining feature 366.

The respiratory assembly 300 further includes a latching mechanism 340 attached to the first respiratory component 320. Particularly, the latching mechanism 340 may be retained to the first respiratory component 320 by a cover 350. The latching mechanism 340 includes first and second latches 344*a* and 344*b* project inwardly toward the first axial passageway 334 when the latching mechanism is assembled with the first respiratory component, such that they engage the at least one retaining feature 366, thereby impeding disengagement of the first respiratory component 320 from the second respiratory component 340. In this exemplary embodiment, the first and second latches 344*a* and 344*b* are parts of a U-shaped construction made from a resilient material. However, various other shapes are within the scope of the present disclosure, such as a V-shape or a straight-sided shape. The first latch 344*a* is disposed on one side of the axial passageway 334, while the second latch 344*b* is disposed on another side of the axial passageway 334, preferably, opposite the second latch 344*b*. In this exemplary embodiment, each latch has a free end 346*a* or 346*b*.

The exemplary latches 344*a* and 344*b* are connected to each other by a resilient member 342, which completes the illustrated U-shaped or bracket-like construction. The resilient member 342 may be attached to the arms or it may be formed integrally with the arms. In this exemplary embodiment, an actuator 346 (illustrated as a push button) is disposed on a side of the latching mechanism 340 that is opposite to the side of the free ends 346*a* and 346*b* of the latches 344*a* and 344*b*. The actuator 346 may be connected to the latches via an elongated transition member 347. When the latching mechanism is assembled, the transition member 347 may be housed in a channel formed by walls 329. The free ends 346*a* and 346*b* may be configured to cooperate with a stop 347 that deflects the latches 344*a* and 344*b* away from each other when force is applied to the actuator in the direction F.

The exemplary latching mechanism 340 can be operated as follows. When force is applied to the actuator 346, in the direction illustrated by the arrow F, the free ends 346*a* and 346*b* of the latches 344*a* and 344*b*, are guided by the sloped sides of the stop 347 away from the first axial passageway 334 thus also causing the latches 344*a* and 344*b* to move away from the first axial passageway 334. Once the latches 344*a* and 344*b* clear and disengage from the retaining feature 366, the second respiratory component 380 may be disengaged from the first respiratory component 320. Conversely, when no force is applied to the actuator 346, or the applied force is insufficient for the latches 344*a*, 344*b* to clear the one or more retaining features 366, the latches remain retained by the one or more retaining features, thereby impeding disengagement of the first respiratory component from the second respiratory component.

Figure 5:
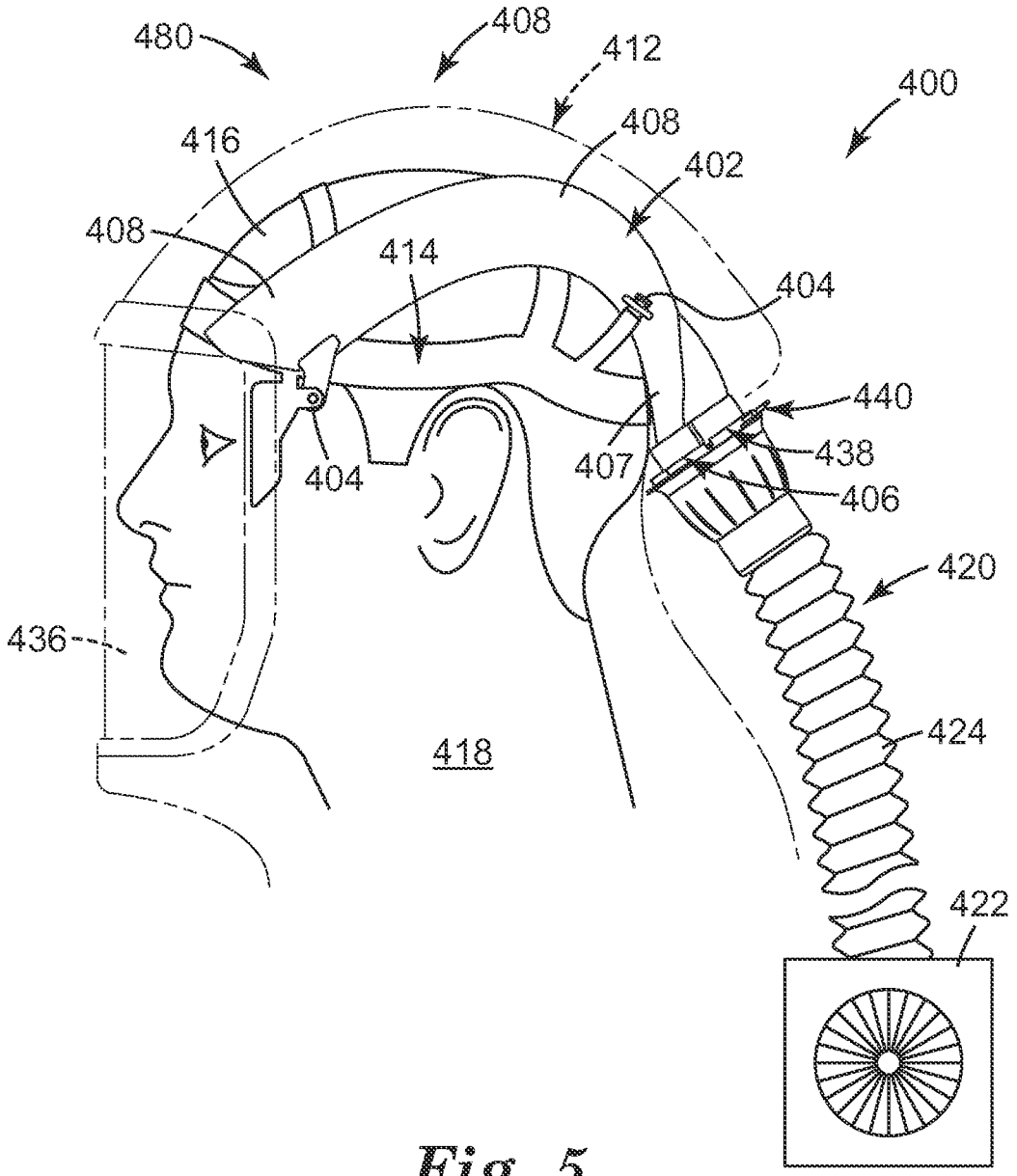
FIG. 5 illustrates another exemplary respiratory assembly according to the present disclosure.

FIG. 5 illustrates another exemplary respiratory assembly respiratory assembly 400 according to the present disclosure. In this exemplary embodiment, the respiratory assembly 400 includes a positive pressure personal respiratory protection device. The respiratory assembly 400 includes a first respiratory component 420 (here, a clean air source) and a second respiratory component 480 (here, a head piece). The second respiratory component 480 includes a non-shape stable hood 412. However, in other exemplary embodiments, the element 412 may be or include a shape-stable head covering or a rigid head covering that is capable of providing impact protection. The second respiratory component 480 further includes a head harness 414 that is adjustable in one or more dimensions so that it may be sized to conform to a head 416 of a user 418. The hood 412 may be sized to extend over at least the front and top of the head of the user or over the entire head.

The respirator assembly 400 may further include an air manifold 402, which is preferably shape stable. The manifold 402 may be removably supported by the harness 414 at a plurality of points such as attachment points 404. The harness 414 and manifold 402 may be fixedly or removably secured together by suitable mechanical fasteners, such as detents, clips, snaps, or two part mechanical fasteners (e.g., hook and loop fasteners). The air manifold 402 has an air inlet conduit 406 in fluid communication with a plurality of air delivery conduits 407 and 408. Air delivery conduits may have one or more air outlets, at least some of which are adjacent a facial area the user 418. The hood 412 includes a visor 436 disposed on a front side thereof through which a user can see.

The air inlet conduit 406 of the manifold 402 extends through an air inlet opening 438 of the head covering 480 and is in fluid communication with a clean air source 420 including a supply of breathable air 422 via an air hose 424 attached to the air inlet conduit 406. Such a supply 422 may take the form of a pressurized tank of breathable air, a powered air-purifying respirator (PAPR) or another supplied breathable air source, as is known. A latching mechanism 440 of this exemplary embodiment is attached to the second respiratory component 480 for releasably connecting the first respiratory component 420 to the second respiratory component 480. The latching mechanism 440 may include any number or combination of suitable features described or shown in the present disclosure. Preferably, the latching mechanism 440 is disposed in the vicinity of the air inlet conduit 406. However, in other exemplary embodiments, the latching mechanism 440 may be attached in another location or to the first respiratory component 420.

Figure 6:
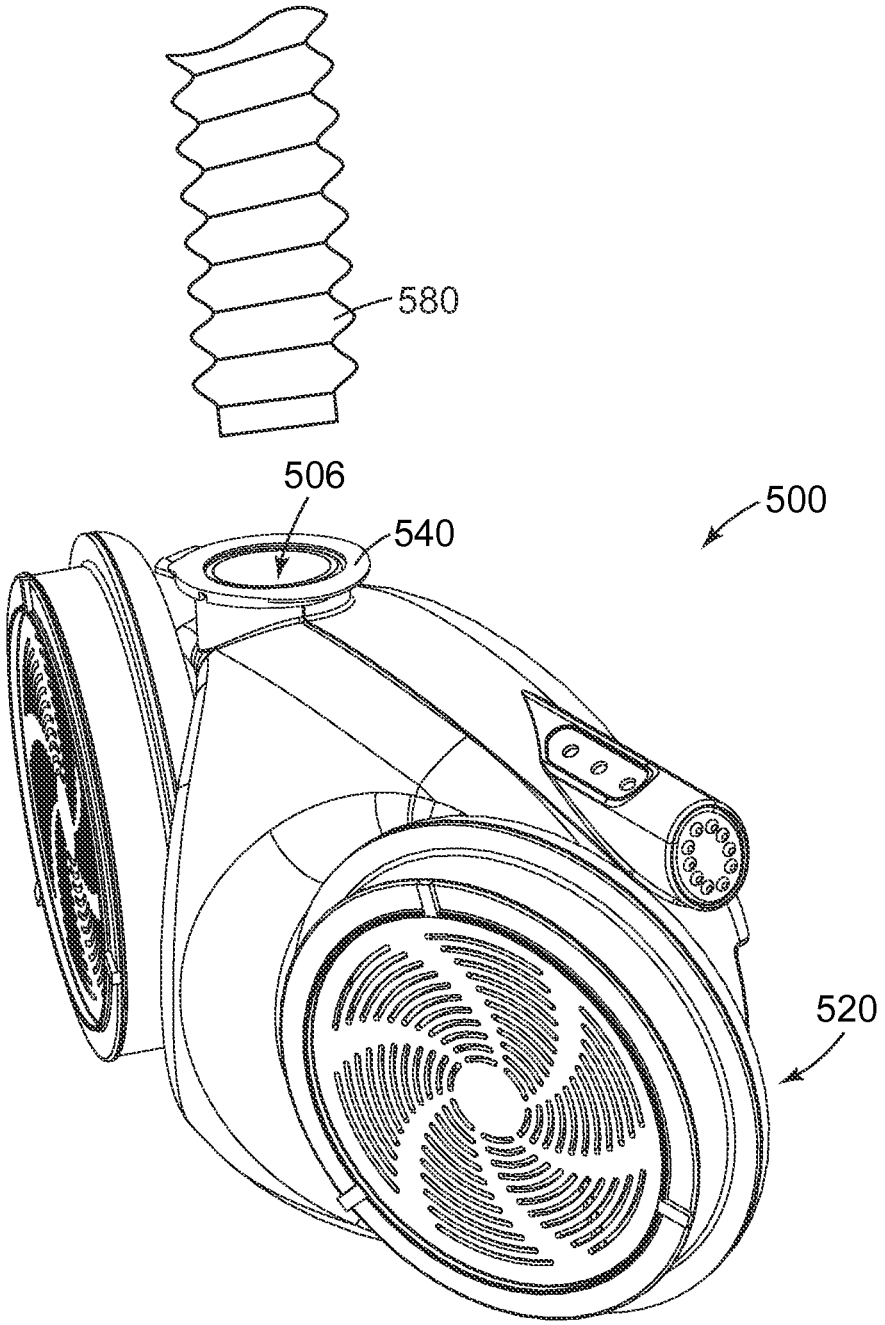
FIG. 6 illustrates yet another exemplary respiratory assembly according to the present disclosure.

FIG. 6 illustrates another exemplary respiratory assembly respiratory assembly 500 according to the present disclosure. In this exemplary embodiment, the respiratory assembly 500 includes components of a positive pressure personal respiratory protection device. The respiratory assembly 500 includes a first respiratory component 520 (here, a turbo unit) and a second respiratory component 580 (here, a hose). Such turbo units typically include, within their outer housing, a fan, a motor for driving the fan, a power source for the motor, and one or more filters. In operation, the fan draws ambient air into the turbo unit, where it is filtered by the one or more filters before being supplied to a user via a hose 580.

A latching mechanism 540 of this exemplary embodiment is attached to the first respiratory component 520 for releasably connecting the first respiratory component 520 to the second respiratory component 580. The latching mechanism 540 may include any number or combination of suitable features described or shown in the present disclosure. Preferably, the latching mechanism 540 is disposed in the vicinity of the air outlet conduit 506. However, in other exemplary embodiments, the latching mechanism 540 may be attached in another location or to the first respiratory component 520.

It will be apparent to those skilled in the art that the specific exemplary structures, features, details, configurations, etc., that are disclosed herein can be substituted, modified and/or combined in numerous embodiments. For example, latching mechanisms described herein may be used with a variety of alternative respiratory assemblies. All such variations and combinations are contemplated by the inventors as being within the bounds of the conceived invention. Thus, the scope of the present invention should not be limited to the specific illustrative structures described herein, but rather by the structures described by the language of the claims, and the equivalents of those structures. To the extent that there is a conflict or discrepancy between this specification and the disclosure in any document incorporated by reference herein, this specification will control.

What is claimed is:

1. A respiratory assembly, comprising:

a first respiratory component comprising a receiving surface having a first axial passageway therein;

a second respiratory component comprising:

at least one retaining feature, a second axial passageway configured and dimensioned to be disposed in fluidic communication with the first axial passageway such that the second respiratory component forms a sealed connection with the receiving surface of the first respiratory component, an annular projection, and a sealing member disposed between the receiving surface and the annular projection, wherein the at least one retaining feature is disposed on the annular projection; and a latching mechanism attached to the first respiratory component, the latching mechanism comprising a resilient member, first and second arms disposed on opposing sides of the first axial passageway and having portions projecting inwardly toward the first axial passageway, and a latch actuator that comprises a free end of each of the first and second arms;

wherein the first and second arms are capable of engaging the at least one retaining feature, thereby impeding disengagement of the first respiratory component from the second respiratory component; and wherein, upon application of a compressive force to the latch actuator, the first and second arms are capable of disengaging from the at least one retaining feature, thereby allowing disengagement of the first respiratory component from the second respiratory component.

2. The respiratory assembly as recited in claim 1, wherein the first respiratory component further comprises an annular projection disposed on the receiving surface and surrounding the first axial passageway, the annular projection of the first respiratory component configured and dimensioned to be received within the annular projection of the second respiratory component.

3. The respiratory assembly as recited in claim 2, wherein the first and second respiratory components each comprise a mating anti-rotation element disposed adjacent the first and second annularly shaped projections.

4. The respiratory assembly as recited in claim 1, wherein the at least one retaining feature comprises a projection, a depression or a combination thereof.

5. The respiratory assembly as recited in claim 1, wherein the latching mechanism comprises first and second latches projecting inwardly toward the first axial passageway on opposing sides thereof, and, wherein, upon application of force to the latch actuator, the first and second latches are capable of moving away from the first axial passageway.

6. The respiratory assembly of claim 1, wherein the first and second respiratory components each comprise an anti-rotation element.

7. A respiratory assembly, comprising:

a mask body comprising a receiving surface having a first axial passageway therein;

a filter cartridge comprising at least one retaining feature and a second axial passageway configured and dimensioned to be disposed in fluidic communication with the first axial passageway such that the filter cartridge forms a sealed connection with the receiving surface of the mask body; and a latching mechanism attached to the mask body, the latching mechanism comprising a resilient member, first and second arms disposed on opposing sides of the first axial passageway and having portions projecting inwardly toward the first axial passageway, and a latch actuator comprising a free end of each of the first and second arms;

wherein the first and second arms are capable of engaging the at least one retaining feature, thereby impeding disengagement of the mask body from the filter cartridge; and wherein, upon application of a compressive force to the latch actuator, the first and second arms are capable of disengaging from the at least one retaining feature, thereby allowing disengagement of the mask body from the filter cartridge.

8. The respiratory assembly as recited in claim 7, wherein the filter cartridge further comprises an annular projection and a sealing member disposed between the receiving surface and the annular projection, wherein the at least one retaining feature is disposed on the annular projection.

9. The respiratory assembly as recited in claim 8, wherein the mask body further comprises an annular projection disposed on the receiving surface and surrounding the first axial passageway, wherein the annular projection of the mask body is configured and dimensioned to be received within the annular projection of the filter cartridge.

10. The respiratory assembly as recited in claim 9, wherein each of the mask body and the filter cartridge comprises a mating anti-rotation element disposed adjacent the annular projection of the mask body and the filter cartridge, respectively.

11. The respiratory assembly as recited in claim 7, wherein the at least one retaining feature comprises a projection, a depression or a combination thereof.

12. The respiratory assembly as recited in claim 7, wherein the latching mechanism comprises first and second latches projecting inwardly toward the first axial passageway on opposing sides thereof, and, wherein, upon application of force to the latch actuator, the first and second latches are capable of moving away from the first axial passageway.

13. The respiratory assembly of claim 7, wherein each of the mask body and the filter cartridge comprises an anti-rotation element.

* * * * *